United States Patent [19]

Hall et al.

[11] Patent Number: 4,634,208

[45] Date of Patent: Jan. 6, 1987

[54] ELECTRICAL PLUG CONNECTOR AND METHOD OF TERMINATING A CABLE THEREWITH

[75] Inventors: Lawrence A. Hall; Daniel E. Stahl, both of Harrisburg, Pa.

[73] Assignee: AMP Incorporated, Harrisburg, Pa.

[21] Appl. No.: 715,856

[22] Filed: Mar. 25, 1985

Related U.S. Application Data

[63] Continuation-in-part of Ser. No. 691,620, Jan. 15, 1985, which is a continuation of Ser. No. 462,278, Jan. 31, 1983, Pat. No. 4,493,525.

[51] Int. Cl.[4] ..... H01R 13/648

[52] U.S. Cl. ..... 339/143 R; 339/14 R

[58] Field of Search ..... 339/14 R, 143 R, 14 L, 339/217 S, 186 M, 176 MP, 218 M; 29/837, 842, 845, 862

[56] References Cited

U.S. PATENT DOCUMENTS

| | | | |
|---|---|---|---|
| 1,474,015 | 11/1923 | Benjamin | 339/142 X |
| 3,141,924 | 7/1964 | Forney, Jr. | 174/75 |
| 3,219,961 | 11/1965 | Bailey et al. | 339/14 |
| 3,227,993 | 1/1966 | Bentley | 339/217 S X |
| 3,335,388 | 8/1967 | Karol | 339/217 S X |
| 3,441,659 | 4/1969 | Laudig et al. | 174/88 |
| 3,611,273 | 10/1971 | Albert | 339/186 M |
| 3,648,222 | 3/1972 | Cowmeadow | 339/14 R |
| 3,694,793 | 9/1972 | Concelman | 339/91 P |
| 3,986,765 | 10/1976 | Shaffer et al. | 339/90 R |
| 4,269,472 | 5/1981 | Shaffer et al. | 339/223 R |
| 4,307,926 | 12/1981 | Smith | 339/177 R |
| 4,310,213 | 1/1982 | Fetterolf, Sr. et al. | 339/103 M |
| 4,316,647 | 2/1982 | Bailey et al. | 339/91 R |
| 4,337,989 | 7/1982 | Asick et al. | 339/143 R |
| 4,361,375 | 11/1982 | Bailey et al. | 339/91 R |
| 4,392,708 | 7/1983 | Bailey et al. | 339/182 R |
| 4,398,784 | 8/1983 | Takihara | 339/182 R |
| 4,493,525 | 1/1985 | Hall et al. | 339/176 MP X |
| 4,497,533 | 2/1985 | Genova et al. | 339/143 R |

FOREIGN PATENT DOCUMENTS

| | | |
|---|---|---|
| 0118168 | 9/1984 | European Pat. Off. . |
| 622912 | 4/1981 | Switzerland . |

*Primary Examiner*—Eugene F. Desmond

*Attorney, Agent, or Firm*—Anton P. Ness

[57] ABSTRACT

A DIN-type plug connector for shielded cable has a one-piece metal shell member in which a housing member has first been inserted and secured. An inwardly-directed projection is stamped into the side surface of the shell member to secure the housing member therein, after which contact-terminated conductors of the cable are inserted through a rear section of the shell member and into housing passageways. The braid of the cable is placed around the rear shell section and a crimping ferrule is crimped therearound, terminating the braid. A rear section of the ferrule is crimped to the outer jacket cable, and an insulating cable guard placed around the assembly. A polarizing U-shaped channel can be stamped into the shell member forwardly of the housing member therewithin for polarized mating with a receptacle. The housing member can have a U-shaped recess therealong to serve as a polarizing indicator and the shell's U-shaped channel can be formed in alignment therewith becoming a polarizing means. A method is provided for assembling the plug connector.

20 Claims, 4 Drawing Figures

10
20
22
24
26
28
30
40
42
44
50
52
60
62
64
70
72
74
76
90
92
94
100
102
104
106
108
46
48

10
40
50
70
72
74
76
92
100
200
202
204
206
208
214
228
232
108
104
106
60
44
102
46
26
22
20
94
48
34
78
90
98
52
30
32
96
24
92
50
222
246
214
236
234
240
252
248
250
220
216
218
238
242
244
226
230
224

ELECTRICAL PLUG CONNECTOR AND METHOD OF TERMINATING A CABLE THEREWITH

CROSS-REFERENCE TO RELATED APPLICATION

This is a continuation-in-part application of application Ser. No. 691,620 filed Jan. 15, 1985, which is a continuation of application Ser. No. 462,278 filed Jan. 31, 1983, now U.S. Pat. No. 4,493,525.

FIELD OF THE INVENTION

This invention relates to electrical connectors and more particularly to electrical plug connectors of the DIN type.

BACKGROUND OF THE INVENTION

Electrical connectors of the DIN type are known and they include a dielectric housing in which three to eight electrical terminals are molded. The terminals are soldered to electrical conductors of a shielded cable. Metal clamshell members are mounted onto the housing with one of the clamshell members having a U-shaped ferrule that is crimped onto the metal shield of the cable to terminate the shield and provide strain relief. An insulating strain relief member is disposed or molded onto the clamshell members and engages the cable adjacent the U-shaped ferrule thereby holding the clamshell members in position on the housing and providing a strain relief.

Soldering of conductors to terminals is time-consuming and cold solder connections can take place. The crimping of the U-shaped ferrule onto the metal shield does not result in a good termination or an effective strain relief. If the insulating strain relief member is pushed onto the clamshell members, there is not a desirable approach to holding the clamshell members in position. If the insulating strain relief member is molded onto the clamshell members, the open area of the back end of the clamshell members must be covered or have viscous dielectric material positioned therein prior to molding to prevent material of the strain relief member from entering the soldered terminations which may break the terminations.

U.S. Pat. No. 4,493,525 teaches an improved DIN-type connector wherein a pair of metal clamshell members are mounted onto a housing member into which terminals terminated to conductors have already been inserted and secured. One of the clamshells have an inwardly-directed arcuate projection disposed in a U-shaped recess along the housing member; the clamshell members have mating lugs and flange recesses, and together form a forward annular hood shielding and protecting the forward contact sections of the terminals in front of the housing member. The clamshell members are necked down at their rearward ends to smaller U-shaped sections forming an annular member surrounding the wire conductors, and onto the U-shaped sections is positioned the braided metallic shield of the shielded cable. A ferrule member placed loosely on the cable is then brought forward over the braid and the clamshell U-shaped sections and crimped thereto forming an excellent mechanical and electrical connection as well as a cable strain relief, and simultaneously securing the clamshell members onto the housing member.

When used in certain specialized applications, such as for high frequency signals, the plug connector of the prior art having a two-part shell and a small seam or gap between the shell members has a disadvantage in that such a gap causes circumferential discontinuity in the shielding and nonuniform ground current distribution. And especially where the ground terminal of the receptacle engages the metal shell of the plug connector at only one location and therefore to only one of the shell members, the shielding effectiveness of the other shell member is reduced. A further disadvantage of the two-part metal shell is that oxides may form in the small gap which eventually cause a deterioration in shielding effectiveness.

It is desirable to provide an improved DIN-type connector having fewer parts. It is also desirable to provide metal shielding means for such a connector which provides improved, circumferentially continuous, 360-degree shielding capability and also better "hoop" strength. It is further desirable to provide a more simplified method of assembly thereof and of application of such a connector to a shielded cable.

SUMMARY OF THE INVENTION

According to the present invention, an electrical connector of the plug type comprises a dielectric housing member in which electrical terminals are to be secured, contact sections of the electrical terminals are to extend outwardly from a front surface of the dielectric housing member, and conductor-securing sections of the electrical terminals are previously connected to electrical conductors of a shielded cable. A one-piece metal shell member having a continuous circumference is mounted onto the housing member prior to insertion of the terminals into passageways of the housing member and being secured therein, forming an outer contact for the connector. The one-piece shell member is drawn having a cylindrical front section and a necked-down rear section of smaller diameter. The cylindrical housing member has an axially extending recess partly along a preselected side from the front surface thereof and is inserted into the shell member prior to the terminals being placed in the housing member. An inwardly-directed dimple-like depression is now formed in the metal shell by an indenter die to extend into the axially extending recess in the housing member at the rearward end of the recess to secure the housing member in the shell member. Forwardly of the front surface of the housing member and the depression thus formed there is also formed in the metal shell a U-shaped channel aligned with the recess which serves as a polarizing means when the connector mates with a receptacle. The housing's recess thus is utilized as a polarizing indicator.

With the ferrule member loosely positioned on the shielded cable and the terminals terminated to individual conductors of the cable, the terminals are now insertable through the rear section of the metal shell into respective terminal-receiving passageways of the housing member and latchably secured therein with contact sections of the terminals extending forwardly of the housing member and being surrounded by a front portion of the metal shell extending forwardly of the housing member. The braided metallic shield of the shielded cable is positioned over the rear section of the metal shell, and the ferrule member is brought forward along the cable to surround the metallic shield on the rear section so that the ferrule member can be crimped onto the rear section with the metallic shield crimped therebetween. The ferrule member is then crimped onto the insulating jacket of the cable. An insulating sleeve is then disposed over the metal shell, the ferrule member and a portion of the cable to insulate the connector and also provide cable strain relief. The metal shell is an outer contact for the connector and when mated to a receptacle is engaged by a ground contact member of the receptacle thus grounding the metal shell and the shield of the cable.

DETAILED DESCRIPTION OF THE PREFERRED EMBODIMENT

Figures 1, 2:
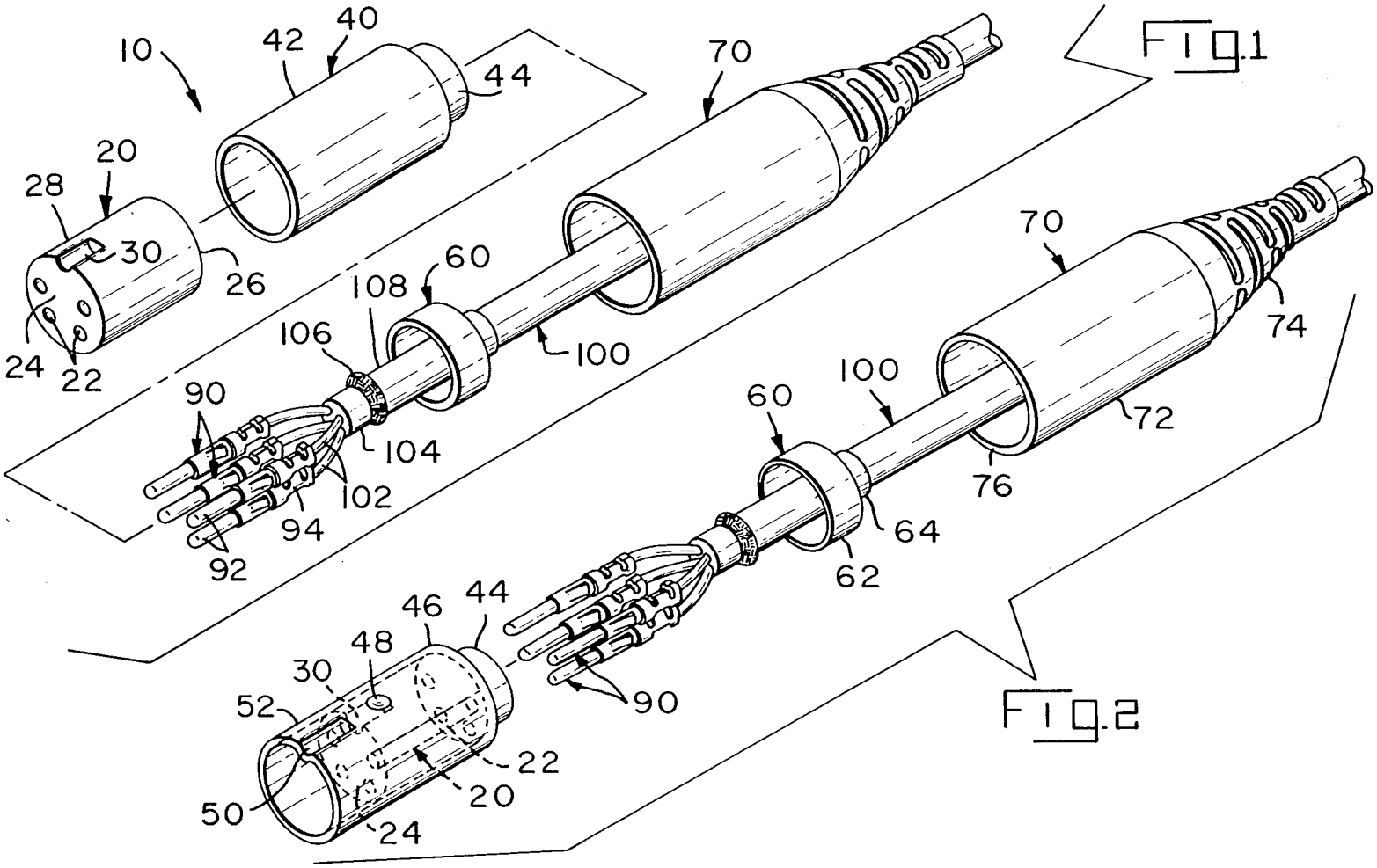
FIG. 1 is an exploded perspective view of the parts of the electrical plug connector.
FIG. 2 is similar to FIG. 1 showing the housing member secured in the metal shell.

A plug connector 10 is illustrated in FIG. 1, having a housing member 20 and a metal shell member 40 and further comprising a crimping ferrule member 60 and a cable guard member 70. Plug connector 10 is to be terminated onto a shielded cable 100 which has insulated electrical conductors 102 positioned within an inner dielectric sheath 104 around which is disposed a braided metallic shield 106 that is covered by an outer insulating jacket 108. Electrical terminals 90 are stamped and formed from a suitable metal in accordance with conventional stamping and forming operations and they include pin contact sections 92 and conductor-securing sections 94. After cable 100 has been stripped to expose the conductive cores of electrical conductors 102 and a suitable amount of shield 106, conductor-securing sections 94 of electrical terminals 90 are crimped onto the conductive cores of electrical conductors 102 in accordance with conventional crimping practices. Alternatively, shielded electrical cable 100 can be formed with electrical conductors twisted together and wrapped with a thin plastic film and the shield can be in the form of a thin metal foil wrapped around the plastic film-encased electrical conductors with a stranded electrical wire extending along the cable within the wrapped metal foil. The cable can, of course, take other forms as desired.

Dielectric housing 20 is molded from a suitable plastic material and has terminal-receiving passageways 22 extending therethrough which preferably vary in number from three to eight. Housing 20 preferably has a simple cylindrical shape, with a forward face 24, a rear face 26, and a U-shaped recess 30 extending axially rearwardly from forward face 24 at least partially along side 28. Metal shell 40 is preferably deep drawn from a suitable metal or is otherwise of a single seamless piece, and preferably has a simple cylindrical sleeve-like body section 42 and is necked down at its rear end to a smaller annular rear section 44. Crimping ferrule member 60 is preferably a circumferentially continuous metal member.

As illustrated in FIG. 2, housing 20 is inserted into body section 42 of shell 40 with forward face 24 facing forwardly and positioned at the resultant annular stop shoulder 46 at the rearward end of body section 42. Housing 20 is then secured in shell 40 by means of an inwardly-directed dimple-like depression 48 being formed in shell 40 by an indenter die (not shown) extending into a portion of U-shaped recess 30 of housing 20. Forwardly of housing 20, in front portion 52 of shell 40 and preferably axially aligned with recess 30 (and depression 48), is formed an inwardly-directed generally U-shaped channel 50 which may be formed simultaneously with depression 48 by the same indenter die. It can be seen that U-shaped recess 30 may be placed at a preselected angular orientation on housing 20 with respect to passageways 22 to serve as an indicator for a polarizing means, so that a channel 50 formed in shell 40 aligned therewith can serve as a polarizing means when the fully assembled and cable-applied plug connector is electrically mated with a receptacle 200, such as is shown in FIGS. 3 and 4, having a corresponding polarizing means (U-shaped recess 208) which assures that contacts 90 of the assembled connector mate with appropriate receptacle contacts.

Figures 3, 4:
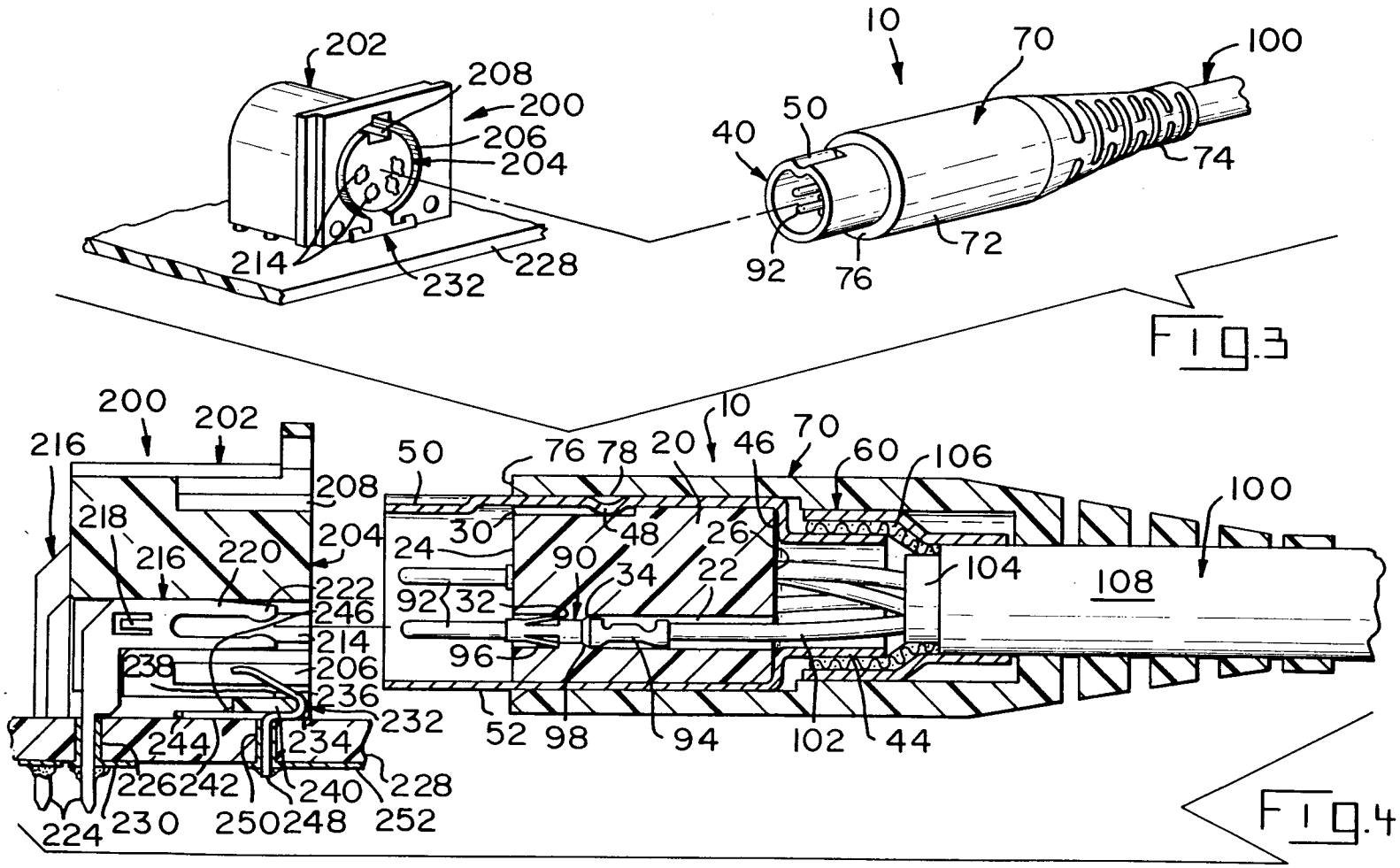
FIG. 3 is a perspective view of the assembled plug connector and a mating receptacle therefor.
FIG. 4 is a longitudinal sectional view of FIG. 3.

With reference to FIG. 4, terminals 90 terminated onto conductors 102 are now inserted through rear section 44 of shell 40 which it can be seen should be of a large enough diameter to facilitate insertion of the plurality of terminals therethrough. The terminals 90 terminated onto conductors are urged forwardly into passageways 22 of housing 20 and are latchably secured therein via spring lances 96 engaging forward retention surfaces 32 and stop sections 98 of conductor-securing sections 94 engaging rear stop surfaces 34 so that pin contact sections 92 extend outwardly from the forward face 24 of housing 20 as shown in FIGS. 3 and 4. In this way, electrical terminals 90 are latchably secured in passageways 22 for removal therefrom by depression of lances 96 by conventional tool means to clear surfaces 32, if desired. Moreover, conductor-securing sections 94 of electrical terminals 90 are completely enclosed within housing 20. Pin contact sections 92 are surrounded and thus shielded and protected by front part 52 of shell 40.

Necked-down annular rear section 44 surrounds insulated portions of conductors 102 forwardly of braid 106 and forms an annular member over which braid 106 is then positioned. Ferrule member 60, which has been previously slidably positioned on cable 100 (and preferably prior to terminating the conductors), has a forward crimping section 62 which is just larger in diameter than shell rear section 44 with braid 106 thereon, and a rear crimping section 64 which is just larger in diameter than the outer diameter of cable 100 to be slidable thereon. Forward crimping section 62 is then moved forwardly along the cable and over braid 106 and controllably crimped onto annular rear section 44 to electrically connect braided shield 106 between forward crimping section 62 of ferrule member 60 and annular rear section 44 of shell 40 thereby forming an excellent mechanical and electrical connection. Rear crimping section 64 is preferably crimped to outer jacket 108 of cable 100 to secure the plug connector to the cable and form a strain relief for cable 100.

Cable guard member 70 is molded from a suitable plastics or elastomeric material and includes a shell-engaging section 72 and a cable-engaging section 74. Cable-engaging section 74 may, for instance, comprise a plurality of concentrically molded and connected rings of decreasing external diameter towards the rear end which are dimensioned to closely receive cable 100 therethrough as shown in FIG. 4. The rings serve to resiliently reinforce cable 100 from extreme lateral manipulation thereof. Cable guard member 70 is positioned onto cable 100 prior to positioning ferrule member 60 thereon and preferably prior to terminating the cable conductors. After shell member 40 has been secured in position on cable 100 via ferrule member 60, cable guard member 70 is moved along cable 100 with shell-engaging section 72 being positioned over ferrule member 60 and onto shell member 40 as shown in FIG. 4. The forward end 76 of cable guard member 70 should preferably coincide with forward face 24 of housing 20 within shell 40. Shell-engaging section 72 of cable guard member 70 preferably has an inside diameter selected to fit snugly on shell 40 after being manually forced thereover, and also preferably has a small projection 78 positioned and sized to fit into depression 48 of shell 40 to further assist in retaining cable guard member 70 on shell 40 and eliminate the need for adhesive material otherwise usable to retain cable guard member 70 in position.

Alternatively, if plug connector 10 is applied to a cable 100 in an appropriately equipped manufacturing facility, an insulative cable guard member may be molded over the finished plug connector/cable assembly. In the overmolding of such a cable guard, the forward end 76 of cable guard 70 is preferably coincident with forward face 24 of housing 20 within shell 40, and it is preferred that U-shaped channel 50 not extend as far rearwardly on shell 40 as forward end 76; thus the moldable insulating material will not flow into channel 50 which would be an undesirable situation. A one-piece metal shell would be somewhat easier to overmold than a two-piece shell.

As shown in FIGS. 3 and 4, an appropriate receptacle 200 comprises a dielectric housing 202 which is molded from a suitable dielectric material such as, for example, glass-filled nylon or the like, and it includes a terminal-receiving section 204 which is surrounded by a channel 206. A U-shaped recess 208 is located in terminal-receiving section 204 and is in communication with channel 206. Terminal-receiving passageways 214 extend through terminal-receiving section 204 in alignment with respective terminal-receiving passageways 22 in dielectric housing 20 of plug connector 10 and they include diametrically-opposed recesses in communication therewith. Electrical terminals 216 are disposed in terminal-receiving passageways 214 and are secured therein by lances 218 in engagement with stop surfaces (not shown) located within the passageways. Electrical terminals 216 have forked contact sections 220 which are located in the opposed recesses of the passageways and the free ends of contact sections 220 are provided with arcuate contact surfaces 222 on the inner surfaces thereof for wiping and spring electrical contact with pin contact sections 92 of electrical terminals 90 when the plug connector 10 is electrically mated with receptacle 200. Other contact sections 224 of electrical terminals 216 are disposed at right angles with respect to forked contact sections 220 and they extend through holes 226 in printed circuit board 228 for electrical connection with respective conductive paths 230, such as by solder connection therewith. Contact sections 224 can be in the form of compliant mounting sections such as those found on ACTION PIN (trademark of AMP Incorporated) terminal posts, for electrical connection with plated through-holes in the printed circuit board or the conductive paths.

A ground terminal is secured in receptacle 200, such as ground terminal 232, which is positioned within a recess 234 in housing 202 with a spring contact member 236 in the form of a cantilever beam extending into channel 206. Hook members 238 engage the top surface of support member 240 within channel 206. Legs 242 of ground terminal 232 are disposed in a bottom recess 244 with lances 246 of legs 242 in engagement with the rear surface of support 240 through an opening in the bottom surface of housing 202 in communication with channel 206, thereby latchably securing ground terminal 232 in position in housng 202 as shown in FIG. 4. In this way, the front portion 52 of metal shell member 40 forming the outer contact of plug connector 10 is electrically connected with spring contact 236 of ground terminal 232 when front shell portion 52 is positioned in channel 206 with U-shaped channel 50 being disposed in U-shaped recess 208 thereby polarizing plug connector 10 in receptacle 200. Ground terminal 232 has other contact sections 248 which extend through holes 250 in printed circuit board 228 for electrical connection to ground plane 252. Other ground terminal embodiments may be used such as are disclosed in U.S. Pat. No. 4,493,525.

As can be discerned, a DIN-type plug connector has been described which provides excellent EMI shielding. The plug connector has fewer parts and in easier to assemble and apply to a cable. An excellent mechanical and electrical connection between the shield of the cable and the outer contact of the connector is also provided. The plug connector of the present invention could be used with a shielded cable having only a single conductor, if desired.

What is claimed is:

1. A shielded plug connector for electrical connection to a plurality of electrical conductors and a shield of a shielded cable, the electrical conductors having electrical terminals terminated thereon which have contact sections for mating with corresponding contact terminals of a receptacle, the plug connector having a dielectric housing means having terminal-receiving passageways therethrough whereinto the electrical terminals are insertable and securable therein, metal shell means around the housing, crimping ferrule means for crimping around a rear section means of the metal shell means to crimpingly secure the shield of the cable therebetween and for crimping around an outer jacket of the cable to secure the plug connector to the cable, and an insulating means around the metal shell means and crimping ferrule means, characterized in that:

said metal shell means is a one-piece shell member having a body section of selected diameter at least as great as the diameter of said dielectric housing means and of an axial length greater than the axial length of said dielectric housing means, and said rear section means of said metal shell means having a reduced diameter less than said diameter of said dielectric housing means, said shell member having a forwardly facing stop surface therewith proximate said rear section means; and said dielectric housing means and said shell member are adapted such that said dielectric housing means is insertable into said shell member from the front thereof and securable therewithin against said stop surface thereof prior to insertion into passageways thereof of the electrical terminals terminated to said plurality of electrical conductors of the shielded cable.

2. A plug connector as set forth in claim 1 further characterized in that a transition section of said shell member between said body section and said rear section means comprises said stop surface.

3. A plug connector as set forth in claim 1 further characterized in that said shell member is cylindrical.

4. A plug connector as set forth in claim 1 further characterized in that said shell member is deep drawn.

5. A plug connector as set forth in claim 1 further characterized in that said shell member is circumferentially continuous.

6. A plug connector as set forth in claim 1 further characterized in that an inwardly-directed projection is formed in said shell member after insertion of said housing means thereinto to secure said housing means therein.

7. A plug connector as set forth in claim 6 further characterized in that said housing means has a recess therealong whereinto said inwardly-directed projection extends.

8. A plug connector as set forth in claim 7 further characterized in that said recess is a polarizing indicator.

9. A plug connector as set forth in claim 1 further characterized in that a U-shaped channel is formed in a front portion of said shell member after insertion of said housing means therein and extending axially rearwardly from a front end of said shell member.

10. A plug connector as set forth in claim 9 further characterized in that said U-shaped channel is disposed forwardly of a forward surface of said housing means.

11. A plug connector as set forth in claim 9 further characterized in that said U-shaped channel is formed simultaneously with the forming of an inwardly-directed projection in said shell member to secure said housing means therein.

12. A plug connector as set forth in claim 11 further characterized in that said U-shaped channel and said inwardly-directed projection are substantially in axial alignment along said shell member.

13. A method of applying an electrical connector to a shielded cable having a plurality of electrical conductors therein, to terminate the cable with a shielded connector, comprising the steps of:

inserting into a front portion of a one-piece metal shell member a dielectric housing means having axially-extending terminal-receiving passageways therethrough;

forming an inwardly-extending projection on said shell member after said insertion to secure said housing means therein;

inserting through a rear section of said shell member and into said housing passageways electrical terminals terminated to respective conductors of the cable and securing said terminals therein;

disposing an end of the shield of the shielded cable around said rear section of said shell member; and crimping a crimping ferrule around said rear section of said shell member thus crimping said shield therebetween.

14. The method of claim 13 further comprising the step of forming an axially-extending U-shaped channel in said front portion of said shell member after said insertion of said housing means therein.

15. The method of claim 14 wherein said forming of said U-shaped channel and said forming of said inwardly-directed projection is by simultaneously stamping said shell member with indenter die means.

16. The method of claim 13 further comprising the steps of crimping a rear section of said ferrule member to the outer jacket of the cable, and providing an insulating means around said shell member and said crimping ferrule.

17. The method of claim 16 wherein said insulating means is molded over said shell member and said crimping ferrule after said crimping steps.

18. The method of claim 16 wherein said insulating means is premolded and is secured around said shell member and said crimping ferrule after said crimping steps.

19. The method of claim 13 wherein said crimping ferrule is circumferentially continuous and is placed on the cable at least prior to said step of inserting said terminals in said housing means.

20. The method of claim 19 wherein a premolded one-piece insulating member is placed on the cable at least prior to said placing of said crimping ferrule thereon and is slid forwardly along the cable after said step of crimping said crimping ferrule around said rear section of said shell member to tightly fit around said shell member and said crimping ferrule.

* * * * *